US010371418B2

(12) United States Patent
Lycklama A Nijeholt et al.

(10) Patent No.: US 10,371,418 B2
(45) Date of Patent: Aug. 6, 2019

(54) THERMO-ACOUSTIC HEAT PUMP

(71) Applicant: STICHTING ENERGIEONDERZOEK CENTRUM NEDERLAND, Petten (NL)

(72) Inventors: Jan-Aiso Lycklama A Nijeholt, Petten (NL); Moulay EL Hassan Tijani, Petten (NL)

(73) Assignee: STICHTING ENERGIEONDERZOEK CENTRUM NEDERLAND, Petten (NL)

( * ) Notice: Subject to any disclaimer, the term of this patent is extended or adjusted under 35 U.S.C. 154(b) by 166 days.

(21) Appl. No.: 15/533,618

(22) PCT Filed: Dec. 8, 2015

(86) PCT No.: PCT/EP2015/079019
§ 371 (c)(1),
(2) Date: Jun. 6, 2017

(87) PCT Pub. No.: WO2016/091900
PCT Pub. Date: Jun. 16, 2016

(65) Prior Publication Data

US 2018/0266733 A1 Sep. 20, 2018

(30) Foreign Application Priority Data

Dec. 8, 2014 (NL) ..... 2013939

(51) Int. Cl.
*F25B 9/14* (2006.01)

(52) U.S. Cl.
CPC ..... *F25B 9/145* (2013.01); *F25B 2309/1404* (2013.01); *F25B 2309/1407* (2013.01);
(Continued)

(58) Field of Classification Search
CPC .... F25B 9/145; F25B 9/14; F25B 2309/1411; F25B 2309/1407; F25B 2309/1404; F25B 2309/1409; F25B 2309/1425
See application file for complete search history.

(56) References Cited

U.S. PATENT DOCUMENTS 5,269,147 A 12/1993 Ishizaki et al.
5,647,216 A 7/1997 Garrett
(Continued)

FOREIGN PATENT DOCUMENTS

DE 45 20 840 A1 1/1993
EP 2 781 856 A1 9/2014
(Continued)

OTHER PUBLICATIONS

International Search Report, dated Feb. 12, 2016, from corresponding PCT application.

*Primary Examiner* — Emmanuel E Duke
(74) *Attorney, Agent, or Firm* — Young & Thompson

(57) ABSTRACT

A thermo-acoustic device for transferring energy by an acoustic wave, includes a resonator; a source for generating the acoustic wave; a thermodynamic section that forms an acoustic network and includes a compliance volume, a thermo-acoustic core and a fluidic inertia. The thermodynamic section is situated between the resonator and the source. The thermo-acoustic core is within the thermodynamic section and includes a cold terminal, a hot terminal and a regenerator. The regenerator is positioned between the hot and cold terminals. The source includes a piston compressor. The compressor is arranged as a mechanical double acting reciprocating piston compressor with a first outlet for a pressure wave generated on one side of the piston and a second outlet for a pressure wave generated on the other side of the piston. The first outlet is coupled with a first thermo-
(Continued)

dynamic section, and the second outlet coupled with a second thermodynamic section.

25 Claims, 3 Drawing Sheets

(52) U.S. Cl.
CPC ..... *F25B 2309/1409* (2013.01); *F25B 2309/1411* (2013.01); *F25B 2309/1425* (2013.01)

(56) References Cited

U.S. PATENT DOCUMENTS

| | | | | |
|---|---|---|---|---|
| 6,314,740 | B1 * | 11/2001 | De Blok | F02G 1/043 62/467 |
| 6,938,426 | B1 | 9/2005 | Acharya et al. | |
| 2010/0212311 | A1 * | 8/2010 | McQuary | F25B 9/14 60/520 |
| 2011/0265493 | A1 * | 11/2011 | Schwartz | F25B 9/145 62/6 |
| 2013/0247593 | A1 | 9/2013 | Hiratsuka et al. | |

FOREIGN PATENT DOCUMENTS

| | | | |
|---|---|---|---|
| JP | 2007040647 | A | 2/2007 |
| JP | 2008 051408 | A | 3/2008 |

* cited by examiner

THERMO-ACOUSTIC HEAT PUMP

FIELD OF THE INVENTION

The invention relates to a thermo-acoustic device, in particular a thermo-acoustic heat pump.

BACKGROUND

Thermo-acoustic devices are used for conversion of acoustic energy to thermal energy and vice versa. Such a thermo-acoustic device is for example known from U.S. Pat. No. 5,647,216.

The thermo-acoustic device is configured to use a tube or vessel as resonator cavity in which a thermodynamic section is placed. The thermodynamic section comprises an acoustic network. Hart of the network is the thermo-acoustic core which comprises a regenerator and two heat exchangers. The heat exchangers are located at the outer ends of the regenerator and are each configured to exchange heat between a respective external fluid flow and the regenerator. An acoustic driver is situated in the vessel at some distance from the regenerator.

The acoustic power delivered by the acoustic driver to the heat pump in the form of an acoustic wave generates a temperature difference across the regenerator which results in cooling of the fluid flow in one heat exchanger at one end and heating of the fluid flow in the other heat exchanger at the other end. In this manner, the thermo-acoustic device acts as a thermo-acoustic heat pump (TAHP) for pumping heat from low to higher temperature.

Designs of TAHPs are presently restricted to relatively low thermal power applications due to the lack of a suitable driver with a sufficiently high acoustic output power. Disadvantageously, many industrial applications require large amount of process heat which cannot be provided with present TAHP devices.

From U.S. Pat. No. 5,647,216 a thermo-acoustic device is known which acts as a thermo-acoustic refrigerator including a half-wave length resonator, first and second drivers located in housings at first and second ends of said resonator, two pusher cones, a plurality of heat exchangers, a first and second stack, utilizing a compressible gas mixture capable of being tuned to the driver resonance frequency. The pusher cones are driven by voice coils (loudspeakers) and act as coupled acoustic sources that in a 180 degree relative phase shift, generate acoustic waves in the resonator. The output power of such a TAHP is limited by the intensity of the acoustic field generated by the voice coils. The electro-acoustic efficiency of loudspeakers is limited, the construction is not robust enough to produce high acoustic pressure, and the loudspeakers can not be scaled up to high power (for example in the MW range).

JP 2008051408 discloses a pulse tube refrigerator includes: a first refrigerating part including a first coldness storage device, a first pulse tube having a first high temperature end and a first low temperature end, a first passage control means and a first buffer tank, which are sequentially connected to a vibration generator; a second refrigerating part including a first coldness storage device, a second coldness storage device, a second pulse tube having a second high temperature end and a second low temperature end, a second passage control means and a second buffer tank, which are sequentially connected to a high pressure passage and a low pressure passage of the vibration generator; a first passage connecting the first coldness storage device and the vibration generator; a second passage connecting the first passage control means and the first pulse tube; and a third passage connecting the second passage control means and the second pulse tube, wherein the pulse tube refrigerator further includes a by-pass passage connecting the respective passages and a passage, a cylinder provided in the by-pass passage, and a displacer provided to reciprocate in the axial length direction of the cylinder.

DE 4220840 discloses a pulse tube refrigerator system that comprises a compressor volume for compressing an working fluid, a radiator coupled to the compressor volume and arranged for radiating heat, and a regenerator coupled with the radiator.

EP 2781856 relates to a two functional thermal driving traveling-wave thermo-acoustic refrigeration system and discloses a heat-actuated double-acting traveling-wave thermo-acoustic refrigeration system, comprising at least three elementary units, wherein each elementary unit comprises a thermo-acoustic engine, a thermo-acoustic refrigerator, and a resonance device; the thermo-acoustic engine and the thermo-acoustic refrigerator comprise a main heat exchanger, a heat regenerator, a non-normal-temperature heat exchanger, a thermal buffer tube, and an auxiliary heat exchange in sequence; the resonance device comprises a sealed housing in which it is equipped with a moving part being in a reciprocating motion, wherein the moving part separates the housing into at least two chambers; the main heat exchanger and auxiliary heat exchanger of each thermo-acoustic engine and thermo-acoustic refrigerator respectively connects to chambers of different housing, forming a dual-loop structure of gas medium flow. In heating the non-normal-temperature heat exchanger of the thermo-acoustic engine to produce acoustic power, thermo-acoustic energy conversion is induced inside the thermo-acoustic engine and the thermo-acoustic refrigerator. It is an object of the invention to overcome one or more of the disadvantages of the prior art.

SUMMARY OF THE INVENTION

The object is achieved by a thermo-acoustic device for transfer of energy by an acoustic wave, comprising:—an acoustic source for generating the acoustic wave;—a thermodynamic section forming an acoustic network and comprising a compliance volume, a thermo-acoustic core and a fluidic inertia; the thermodynamic section being situated adjacent to the acoustic source; the thermo-acoustic core being situated in the thermodynamic section and comprising a cold terminal section, a hot terminal section and a regenerator, the regenerator being positioned between the hot and cold terminal sections, wherein the acoustic source comprises a reciprocating piston compressor for producing a pressure wave, the compressor being arranged as a mechanical double acting reciprocating piston compressor with—a first outlet for a pressure wave generated on one side of the piston and—a second outlet for a pressure wave generated on the other side of the piston; the thermodynamic section being divided in a first thermodynamic subsection and a second thermodynamic subsection; the first outlet being in fluid communication with a first thermodynamic subsection, and the second outlet being in fluid communication with a second thermodynamic subsection.

By use of such a mechanical compressor, the invention achieves that the acoustic driver can generate acoustic waves of relatively high output power levels which contribute to a high power output of the heat pump, higher than can be produced by a by a loudspeaker or linear motor. In this way thermo-acoustic heat pumps can be developed over a larger power scale than can be achieved up to date. Moreover, the use of a double acting mechanical compressor which is configured to power two thermo-acoustic cores improves the thermal output of the TAHP.

According to an aspect, the invention provides a thermo-acoustic device as described above wherein the first thermodynamic subsection is a first portion of the thermodynamic section with the first portion coupled to the first outlet and the second thermodynamic subsection is a second portion of the same thermodynamic section with the second portion coupled to the second outlet.

According to an aspect, the invention provides a thermo-acoustic device as described above, wherein the first thermodynamic subsection is a first thermo-acoustic device coupled to the first outlet and the second thermodynamic subsection is a second thermo-acoustic device coupled to the second outlet.

According to an aspect, the invention provides a thermo-acoustic device as described above, wherein the first thermodynamic subsection comprises a first thermo-acoustic core part and the second thermodynamic subsection a second thermo-acoustic core part such that the first outlet is in fluid communication with the first thermo-acoustic core part and the second outlet is in fluid communication with the second thermo-acoustic core part.

According to an aspect, the invention provides a thermo-acoustic device as described above, wherein the double acting reciprocating piston compressor is arranged for generating acoustic waves with a frequency in the range of 10 to 30 Hz.

According to an aspect, the invention provides a thermo-acoustic device as described above, wherein the double acting reciprocating piston compressor is arranged for generating acoustic waves with a pressure amplitude in the range of 1 to 10 bar.

According to an aspect, the invention provides a thermo-acoustic device as described above, wherein a system pressure of the thermo-acoustic device is in the range of about 20 to about 100 atm.

According to an aspect, the invention provides a thermo-acoustic device as described above, wherein the double acting reciprocating piston-driven compressor has an acoustic power input per piston between about 50 and about 1000 kW.

According to an aspect, the invention provides a thermo-acoustic device as described above, wherein the cold terminal section and the hot terminal section each extend in the first portion of the thermodynamic section and in the second portion of the thermodynamic section, the regenerator comprising a first regenerator in a first portion of the acoustic network and a second regenerator in a second portion of the acoustic network.

According to an aspect, the invention provides a thermo-acoustic device as described above, wherein the thermo-acoustic core comprises a first thermo-acoustic core in the first portion of the thermodynamic section and a second thermo-acoustic core in the second portion of the thermodynamic section, each of the first and second thermo-acoustic cores comprising a cold terminal, a hot terminal and a regenerator.

According to an aspect, the invention provides a thermo-acoustic device as described above, wherein the first thermo-acoustic core is thermally coupled in series with the second thermo-acoustic core.

According to an aspect, the invention provides a thermo-acoustic device as described above, wherein the first thermo-acoustic core is thermally coupled in parallel to the second thermo-acoustic core.

According to an aspect, the invention provides a thermo-acoustic device as described above, wherein the thermodynamic section comprises a lengthwise partition forming the first portion and the second portion.

According to an aspect, the invention provides a thermo-acoustic device as described above, wherein each portion comprises a bypass channel adjacent to the part of the thermo-acoustic core in said portion.

According to an aspect, the invention provides a thermo-acoustic device as described above, wherein each thermodynamic subsection is coupled with a respective resonator section and the thermodynamic subsection is situated between the resonator section and the acoustic source.

According to an aspect, the invention provides a thermo-acoustic device as described above, wherein the resonator section comprises an acoustical resonator.

According to an aspect, the invention provides a thermo-acoustic device as described above, wherein the resonator section comprises a mass-spring arrangement as mechanical resonator.

According to an aspect, the invention provides a thermo-acoustic device as described above, comprising a resonator section, wherein the resonator section is a closed cavity, which with respect to the acoustic source is behind the thermodynamic section, with the thermodynamic section intermediate the acoustic source and the compliance volume.

According to an aspect, the invention provides a thermo-acoustic device as described above, wherein the thermodynamic section is arranged in a closed cavity, which with respect to the acoustic source is behind the thermodynamic section, with the thermodynamic section intermediate the acoustic source and the compliance volume.

According to an aspect, the invention provides a thermo-acoustic device as described above, comprising a closed volume in which two thermodynamic subsections, each with a respective thermo-acoustic core section and compliance volume are placed, the thermodynamic subsections being formed in the closed volume by a separator wall.

According to an aspect, the invention provides a thermo-acoustic device as described above, wherein the device is configured as a heating and/or cooling device.

According to an aspect, the invention provides a thermo-acoustic device as described above, wherein the device is configured as a part of a power generator device by a coupling of the piston as driving element to a generator to produce electricity.

According to an aspect, the invention provides a thermo-acoustic system comprising at least one thermo-acoustic device as described above.

According to an aspect, the invention provides a thermo-acoustic system as described above, wherein the mechanical double acting reciprocating piston compressor is a reciprocating multi-piston compressor, with a plurality of double acting pistons in which each of the pistons is acting as an acoustic source for an associated thermo-acoustic device by coupling the first and second outputs of the respective piston to the first and the second inlet, of the associated thermo-acoustic device.

Advantageous embodiments are further defined by the dependent claims.

BRIEF DESCRIPTION OF THE DRAWINGS

The invention will be explained in more detail below with reference to drawings in which embodiments of the invention are shown. The drawings are intended for illustrative purposes without limitation of the scope of protection of the invention. The invention is defined by the subject matter of the appended claims.

In the accompanying drawings.

In each of the drawings, entities with the same reference number refer to corresponding entities. It should be understood that such entities are either substantially identical or equivalent, unless described otherwise.

DETAILED DESCRIPTION OF EMBODIMENTS

Figure 1:
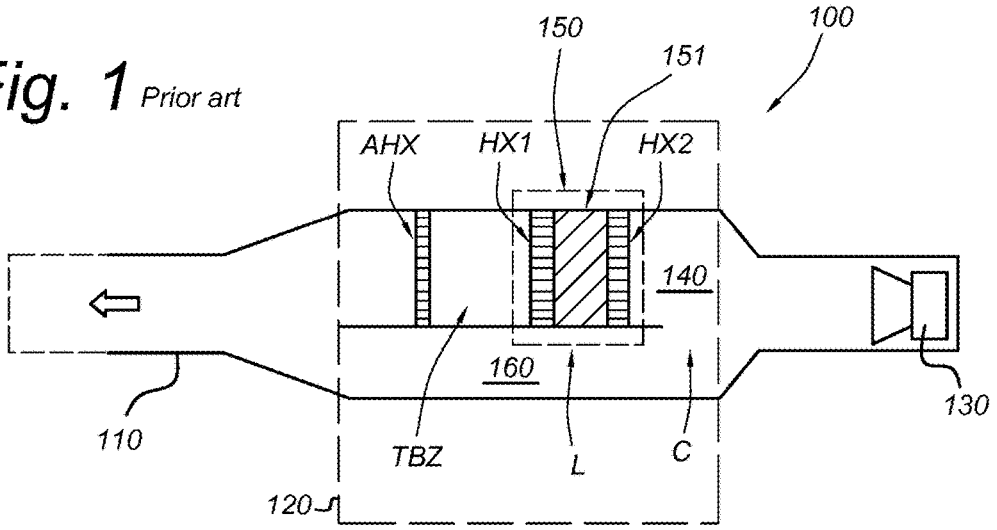
Fig. 1 Prior art
FIG. 1 schematically shows a thermo-acoustic device according to the prior art.

FIG. 1 schematically shows a thermo-acoustic device 100 according to the prior art.

The thermo-acoustic device 100 comprises a resonator section 110, a thermodynamic section 120, and an acoustic source 130. The thermodynamic section 120 is typically arranged intermediate the resonator section 110 and the acoustic source 130. The skilled in the art will appreciate that only an inlet of the resonator section 110 is shown in FIG. 1.

According to the prior art the acoustic source 130 typically comprises a loudspeaker or linear motor The thermodynamic section 120 comprises a compliance volume 140 (compliance C), a thermo-acoustic core (fluidic resistance R) 150 and a fluidic inertia 160 (inertance L). The compliance volume 140, the thermo-acoustic core 150, and the fluidic inertia 160 form an acoustic circuit (RLC) that is configured to create the traveling-wave phasing of the acoustic wave necessary to operate in a Stirling cycle during use.

The thermo-acoustic core comprises a regenerator 151 placed between two heat exchangers HX1, HX2. The regenerator 151 is the location in the thermo-acoustic device 100 where the thermo-acoustic heat pumping effect (as described above) takes place.

The two heat exchangers HX1, HX2 (cold and hot) are necessary for an exchange of heat with an external heat source and heat sink respectively (both not shown). Optionally, the thermodynamic section 120 comprises a first thermal buffer zone TBZ. The first thermal buffer zone TBZ is positioned between the thermo-acoustic core 150 and the resonator section 110. A gas column in the first thermal buffer zone TBZ provides thermal insulation for the heat exchanger HX1 facing the resonator. It should be noted that a second thermal buffer zone can be arranged between the other heat exchanger HX2 and the compliance volume 140.

Further, the first and second thermal buffer zone TBZ optionally comprises at a distal end thereof an ambient heat exchanger AHX for interception of heat leaking down the first and second thermal buffer zone TBZ.

Figure 2:
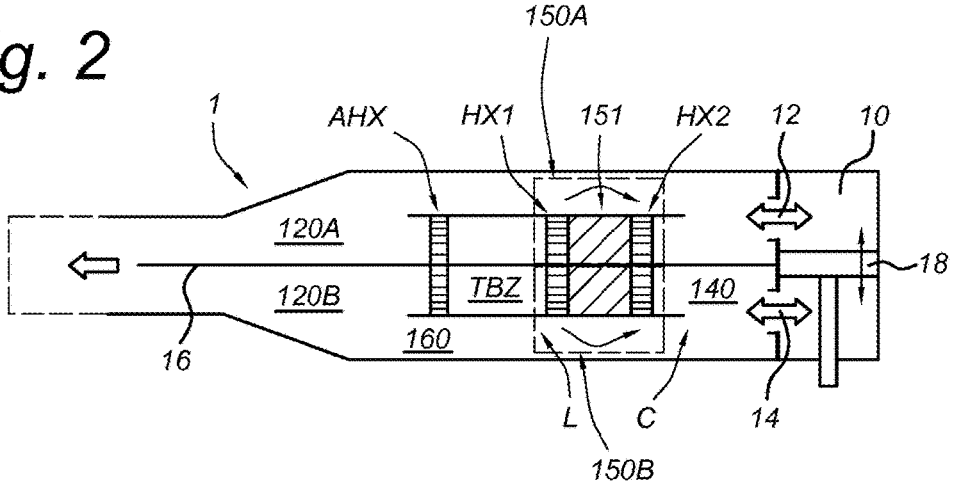
FIG. 2 schematically shows a thermo-acoustic device according to an embodiment of the invention.

FIG. 2 shows a thermo-acoustic device 1 according to an embodiment of the present invention. The thermo-acoustic device 1 comprises a thermodynamic section that is divided by a separator wall 16 in a first thermodynamic section part or subsection 120A and a second thermodynamic section part or subsection 120B that runs parallel to each other between an acoustic source 10 and the inlet of the resonator section 110.

The first thermodynamic subsection 120A comprises a thermo-acoustic core portion 150A which has a regenerator placed between two heat exchangers. Similarly the second thermodynamic subsection 120B comprises a second thermo-acoustic core portion 150B which has a regenerator placed between two heat exchangers. In this embodiment each heat exchanger (HX1 and/or HX2) can be arranged either as one heat exchanger extending across both first and second thermodynamic subsections or as individual heat exchangers within a respective thermodynamic subsection. In case individual heat exchangers in each of the first and second thermodynamic subsections, these heat exchangers can be connected in series or connected in parallel.

The acoustic source 10 is coupled to the first thermodynamic subsection 120A through first inlet 12 and to the second thermodynamic subsection 120B through second inlet 14.

According to the invention, the acoustic source 10 comprises a reciprocating piston compressor with a piston 18 for producing pressure waves as acoustic waves.

The acoustic source 10 is arranged as a mechanical double acting reciprocating piston-driven compressor which has a first outlet for a pressure wave generated by one side of the piston (i.e. in a first stroke direction) and a second outlet for a pressure wave generated by the other side of the piston (i.e., in a second opposite stroke direction).

The stroke direction is substantially transverse to a main axis of the thermo-acoustic device 1 which main axis runs from the acoustic source via the thermo-acoustic core to the resonator section (for each thermodynamic section).

The first outlet is in fluid communication with the first inlet 12, the second outlet is in fluid communication the second inlet 14 of the thermo-acoustic device 1.

The use of a mechanical piston gas compressor allows to produce acoustic waves of high intensity, which allows that the heat pump can handle large heat flows. Compressors can handle large gas sweep volumes and are commercially available over a large power scale.

Moreover, by using the compressor in a double acting mode the output power of the compressor is doubled compared to a single acting compressor with similar bore and stroke. To utilize the pressure wave in both stroke directions, the first thermodynamic subsection 120A is coupled to one outlet of the compressor and driven by the pressure wave generated by the corresponding piston face in one stroke direction. The second thermodynamic subsection 120B is coupled to the other outlet of the compressor and thus driven by pressure waves generated by the second piston face in opposite stroke direction.

Figure 3:
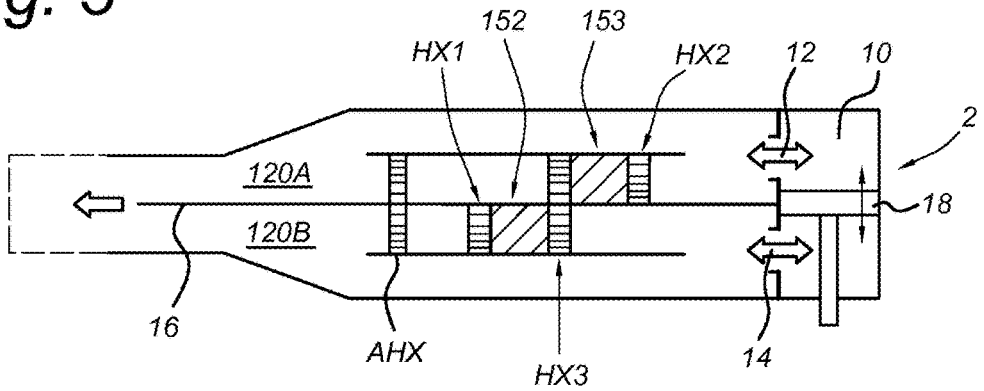
FIG. 3 schematically shows a thermo-acoustic device according to an embodiment of the invention.

FIG. 3 is acoustically similar to arrangement shown in FIG. 2 with two separated thermodynamic subsections. The two thermodynamic subsections are thermally coupled in series by means of a middle heat exchanger HX3 while in the embodiment shown in FIG. 2 a parallel thermal coupling of the two thermodynamic parts is used.

Figure 4:
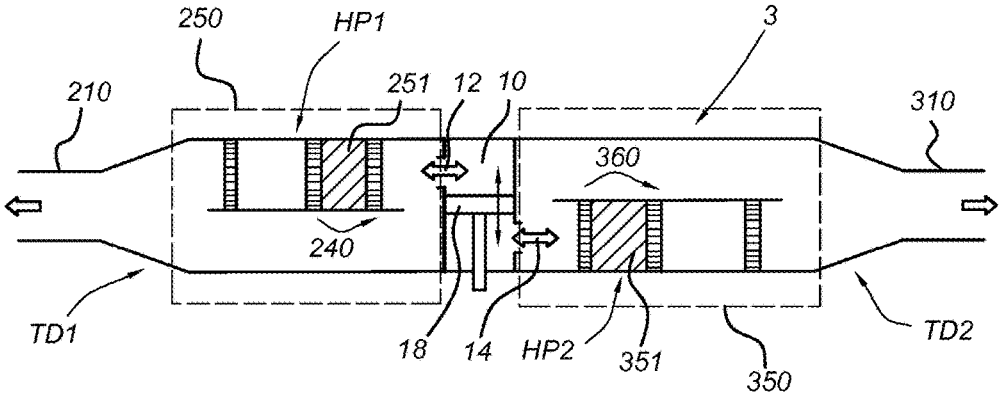
FIG. 4 schematically shows a thermo-acoustic device in accordance with the present invention, FIG. 5 schematically shows a thermo-acoustic device in accordance with the present invention.

FIG. 4 schematically shows a thermo-acoustic device arrangement 3 according to an embodiment of the invention.

In this embodiment, the thermo-acoustic device arrangement comprises a first and a second thermo-acoustic device TD1, TD2.

The acoustic source 10 of a mechanical double acting reciprocating piston compressor is coupled to both the first and second thermo-acoustic devices TD1, TD2 by means of a first and a second entry 12, 14 respectively.

Each thermo-acoustic device TD1, TD2 is equipped with a respective thermodynamic subsection 250, 350 and resonator 210, 310 that have been explained with reference to FIG. 1. Note that only the inlets of the resonator sections are shown, the resonator sections are schematically shown by the dashed contours.

In a further embodiment, the resonators 210, 310 of the two thermo-acoustic devices TD1, TD2 can be coupled to form a closed resonator loop.

Figure 5:
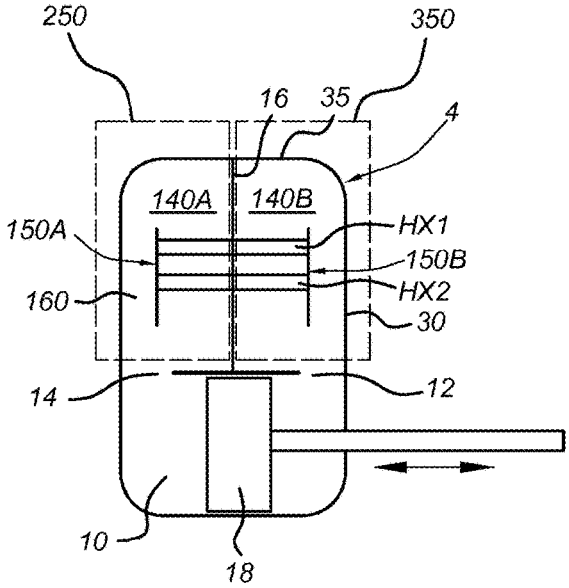

FIG. 5 schematically shows a thermo-acoustic device 4 in accordance with the present invention.

In this embodiment, the thermo-acoustic device 4 comprises a closed volume 30 in which two thermodynamic subsections 250 and 350 with a respective thermo-acoustic core section 150A, 150 B and compliance volume 140A, 140B, are placed. The thermodynamic subsections have been formed by a separator wall 16. The cylinder of the compressor 10 is coupled to the first and second inlets 12, 14 of thermodynamic subsections 250 and 350, respectively such that one side of the piston 18 is arranged to provide a pressure wave at the first inlet 12 and the other side of the piston 18 is arranged to provide a pressure wave at the second inlet 14.

The compressor generates pressure fluctuations in the thermodynamic subsections 250 and 350 by compressing and expanding the gas periodically at a given frequency. In other words, the reciprocating piston of the compressor functions as a mechanical resonator, i.e., replaces the resonator.

Figure 6:
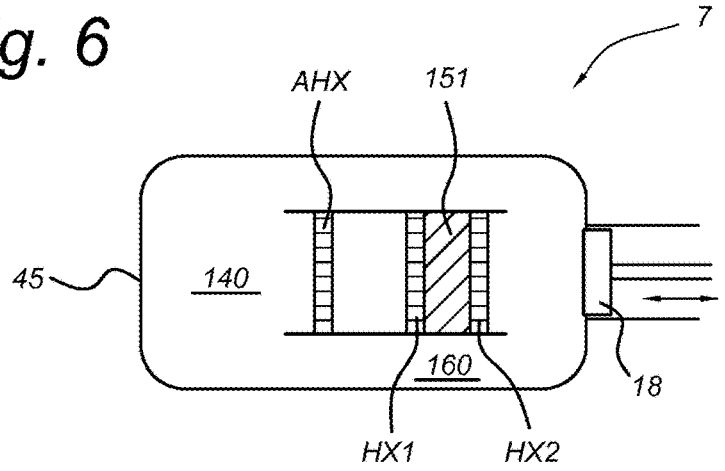
FIG. 6 schematically shows a thermo-acoustic device in accordance with the present invention.

FIG. 6 schematically shows a thermo-acoustic device 7 in accordance with the present invention similar to the embodiment described with reference to FIG. 5.

The thermo-acoustic device comprises a reciprocating piston that is arranged to have reciprocating motion, parallel with the main axis, i.e., with one side of the piston in the direction of the thermo-acoustic core, towards/from the thermo-acoustic core.

Figure 7:
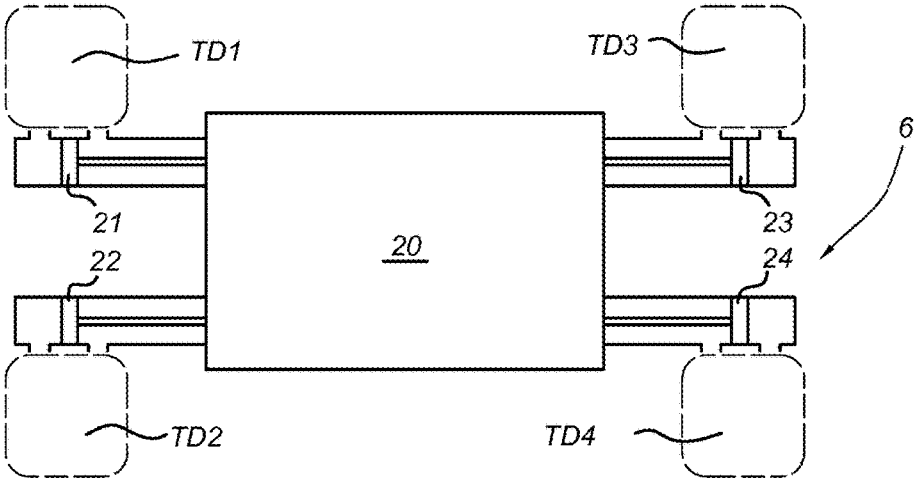
FIG. 7 shows an arrangement of multiple thermo-acoustic devices in accordance with the invention.

FIG. 7 shows an arrangement 6 of multiple thermo-acoustic devices TD1, TD2, TD3, TD4 in accordance with the invention.

According to the embodiment, the mechanical double acting reciprocating piston-driven compressor 20 is a multi-piston reciprocating compressor. Each of the pistons 21, 22, 23, 24 is used as an acoustic source for one thermo-acoustic device TD1, TD2, TD3, TD4 that can be constructed according to any of the above embodiments.

In this manner, a multiple heat pump system is created with high thermal output power that scales linear with the number of cylinders.

This is advantageous for industrial applications when a large quantity of process heat is needed and the compressors are generally multi-throws systems. A large multi-throws compressor can be used to power a multi-heat pump system to generate high thermal power at high temperature. A large multi-throws compressor is less expensive than using separate smaller compressors for each heat pump. Additionally, the control equipment for the compressor(s) will be less expensive as only one will be needed if only one large multi-throws compressor is used. Another advantage of using a multi-throws system is to have a mechanically balanced system to minimize the vibrations and noise produced by the system.

It should be appreciated that in the above the resonator can be an acoustic resonator ($\lambda$, $\lambda/2$, $\lambda/4$, etc.) but it can also be a mechanical resonator consisting of a mass-spring oscillator.

The mechanical double acting reciprocating piston-driven compressor can be driven by any type of drive such as an electrical motor, an internal combustion engine, or a turbine.

Additionally, the thermo-acoustic device can be used as power generator by a coupling of the piston as driving element to an electrical generator to produce electricity. In this embodiment, the heat pump is replaced by a thermo-acoustic engine that produces acoustic power from heat to drive the piston. The piston drives then an electrical generator.

Although specific embodiments of the invention have been described, it should be understood that the embodiments are not intended to limit the invention. The invention may embody any alternative, modification or equivalent. It is intended that the invention be construed as including all such modifications and alterations insofar as they come within the scope of the appended claims.

The invention claimed is:

1. A thermo-acoustic device (1; 2; 3; 4; 5; 6) for transfer of energy by an acoustic wave, comprising:

an acoustic source (10) for generating the acoustic wave;

a thermodynamic section forming an acoustic network (RLC) and comprising a compliance volume (140), a thermo-acoustic core (150) and a fluidic inertia (160);

a resonator;

the thermodynamic section being situated between the resonator and the acoustic source, adjacent to the acoustic source;

the thermo-acoustic core being situated in the thermodynamic section and comprising a cold terminal section (HX1), a hot terminal section (HX2) and a regenerator (151), the regenerator being positioned between the hot and cold terminal sections;

wherein the acoustic source (10) comprises a reciprocating piston compressor (18) for producing a pressure wave, the compressor being arranged as a mechanical double acting reciprocating piston compressor with a first outlet for a pressure wave generated on one side of the piston (18) and a second outlet for a pressure wave generated on the other side of the piston (18), the thermodynamic section being divided in a first thermodynamic subsection and a second thermodynamic subsection;

the first outlet (12) being in fluid communication with a first thermodynamic subsection, and the second outlet (14) being in fluid communication with a second thermodynamic subsection, with a stroke direction of the piston compressor being transverse to a main axis of the thermo-acoustic device.

2. Thermo-acoustic device according to claim 1, wherein the first thermodynamic subsection is a first portion of the thermodynamic section with the first portion coupled to the first outlet and the second thermodynamic subsection is a second portion of the same thermodynamic section with the second portion coupled to the second outlet.

3. Thermo-acoustic device according to claim 2, wherein the cold terminal section and the hot terminal section each extend in the first portion of the thermodynamic section and in the second portion of the thermodynamic section, the regenerator comprising a first regenerator in a first portion of the acoustic network and a second regenerator in a second portion of the acoustic network.

4. Thermo-acoustic device according to claim 2, wherein the thermo-acoustic core comprises a first heat thermo-acoustic core in the first portion of the thermodynamic section and a second thermo-acoustic core in the second portion of the thermodynamic section, each thermo-acoustic core comprising a cold terminal, a hot terminal and a regenerator.

5. Thermo-acoustic device according to claim 4, wherein the first thermo-acoustic core is thermally coupled in series with the second thermo-acoustic core.

6. Thermo-acoustic device according to claim 4, wherein the first thermo-acoustic core is thermally coupled in parallel to the second thermo-acoustic core.

7. Thermo-acoustic device according to claim 2, wherein the thermodynamic section comprises a lengthwise partition forming the first portion of the thermodynamic section and the second portion of the thermodynamic section.

8. Thermo-acoustic device according to claim 2, wherein each portion comprises a bypass channel adjacent to the part of the thermo-acoustic core section in said tube portion.

9. Thermo-acoustic device according to claim 2, comprising a closed volume in which two thermodynamic subsections, each with a respective thermo-acoustic core and a compliance volume, are placed, the thermodynamic subsections being formed in the closed volume by a separator wall.

10. Thermo-acoustic device according to claim 1, wherein the first thermodynamic subsection is a first thermo-acoustic device coupled to the first outlet and the second thermodynamic subsection is a second thermo-acoustic device coupled to the second outlet.

11. Thermo-acoustic device according to claim 10, wherein the thermodynamic section is arranged in a closed cavity, which with respect to the acoustic source is behind the thermodynamic section, with the thermodynamic section intermediate the acoustic source and the compliance volume.

12. Thermo-acoustic device according to claim 1, wherein the first thermodynamic subsection comprises a first thermo-acoustic core part and the second thermodynamic subsection a second thermo-acoustic core part such that the first outlet is in fluid communication with the first thermo-acoustic core part and the second outlet is in fluid communication with the second thermo-acoustic core part.

13. Thermo-acoustic device according to claim 1, wherein the double acting reciprocating piston compressor is arranged for generating acoustic waves with a frequency in the range of 10 to 30 Hz.

14. Thermo-acoustic device according to claim 13, wherein the double acting reciprocating piston compressor is arranged for generating acoustic waves with a pressure amplitude in the range of 1 to 10 bar.

15. Thermo-acoustic device according to claim 13, wherein a system pressure of the thermo-acoustic device is in the range of about 20 to about 100 atm.

16. Thermo-acoustic device according to claim 13, wherein the double acting reciprocating piston-driven compressor has an acoustic power input per piston between about 50 and about 1000 kW.

17. Thermo-acoustic device according to claim 1, wherein each thermodynamic subsection is coupled with a respective resonator section and the thermodynamic subsection is situated between the resonator section and the acoustic source.

18. Thermo-acoustic device according to claim 17, wherein the resonator section comprises an acoustical resonator.

19. Thermo-acoustic device according to claim 17, wherein the resonator section comprises a mass-spring arrangement as mechanical resonator.

20. Thermo-acoustic device according to claim 1, wherein the device is configured as a heating and/or cooling device.

21. Thermo-acoustic device according to claim 1, wherein the device is configured as a part of a power generator device by a coupling of the piston as driving element to a generator to produce electricity.

22. Thermo-acoustic device according to claim 1, wherein the thermo-acoustic device comprises a separator wall that divides the thermodynamic section in the first thermodynamic subsection and the second thermodynamic subsection that run parallel to each other between the acoustic source and the resonator.

23. Thermo-acoustic device according to claim 1, wherein the thermo-acoustic device is a closed volume in which two thermodynamic subsections with a respective thermo-acoustic core section and compliance volume are placed and the thermodynamic subsections have been formed by a separator wall within the closed volume, and wherein the compressor is coupled to first and second inlets of thermodynamic subsections, respectively such that one side of the piston of the compressor is arranged to provide a pressure wave at the first inlet and the other side of the piston is arranged to provide a pressure wave at the second inlet causing the reciprocating piston to function as the resonator by generating pressure fluctuations in the thermodynamic subsections at a predetermined frequency.

24. Thermo-acoustic system comprising at least one thermo-acoustic device according to claim 1.

25. Thermo-acoustic system according to claim 24, wherein the mechanical double acting reciprocating piston compressor is a reciprocating multi-piston compressor, with a plurality of pistons wherein each of the pistons is acting as an acoustic source for an associated thermo-acoustic device by coupling the first and second outputs of the respective cylinder to the first and the second inlet, of the associated thermo-acoustic device.

* * * * *